United States Patent [19]

Malhotra

[11] Patent Number: 4,573,280

[45] Date of Patent: Mar. 4, 1986

[54] PISTOL AND GRIP-AND-TRIGGER GUARD ASSEMBLY

[75] Inventor: Satish K. Malhotra, Steyr, Austria

[73] Assignee: Steyr-Daimler-Puch Aktiengesellschaft, Vienna, Austria

[21] Appl. No.: 605,680

[22] Filed: Apr. 30, 1984

[30] Foreign Application Priority Data

May 4, 1983 [AT] Austria ..... 1637/83

[51] Int. Cl.[4] ..... F41C 3/00; F41C 25/06

[52] U.S. Cl. ..... 42/7

[58] Field of Search ..... 42/7

[56] References Cited

U.S. PATENT DOCUMENTS

| | | | |
|---|---|---|---|
| 1,397,109 | 11/1921 | Pedersen | 42/7 |
| 4,236,337 | 12/1980 | Beretta | 42/7 |
| 4,326,353 | 4/1982 | Ludwig et al. | 42/7 |
| 4,449,311 | 5/1984 | Giragosian | 42/7 |

FOREIGN PATENT DOCUMENTS

| | | | |
|---|---|---|---|
| 55913 | 10/1912 | Austria | 42/7 |
| 358427 | 9/1980 | Austria . | |
| 672094 | 2/1939 | Fed. Rep. of Germany | 42/7 |
| 2845121 | 11/1980 | Fed. Rep. of Germany . | |
| 3300614 | 8/1983 | Fed. Rep. of Germany | 42/7 |

*Primary Examiner*—Charles T. Jordan

*Attorney, Agent, or Firm*—Karl F. Ross; Herbert Dubno

[57] ABSTRACT

A pistol comprises a substantially U-shaped magazine catch, which is slidably mounted in a track that extends transversely to the longitudinal direction of the magazine. One leg of the magazine catch constitutes a pushpiece. The other leg of the magazine catch constitutes a locking member, which extends into a lateral slot of the magazine. A compression spring is provided, which extends along the track and holds the magazine catch in engagement with the magazine. To facilitate the alteration of the pistol from a condition for use by a right-handed person to a condition for use by a left-handed person, the track is provided in the detachable trigger guard and is open toward that surface of the trigger guard which adjoins the grip. The crosspiece of the magazine catch has a recess, which receives an abutment member, which is held in the track by stop noses against a movement along the track. The spring which acts on the pushpiece constituted by one leg of the magazine catch bears on the abutment member, which extends from the crosspiece as far as to the surface with which the trigger guard adjoins the grip. The latter has two slots for receiving the legs of the magazine catch.

3 Claims, 3 Drawing Figures

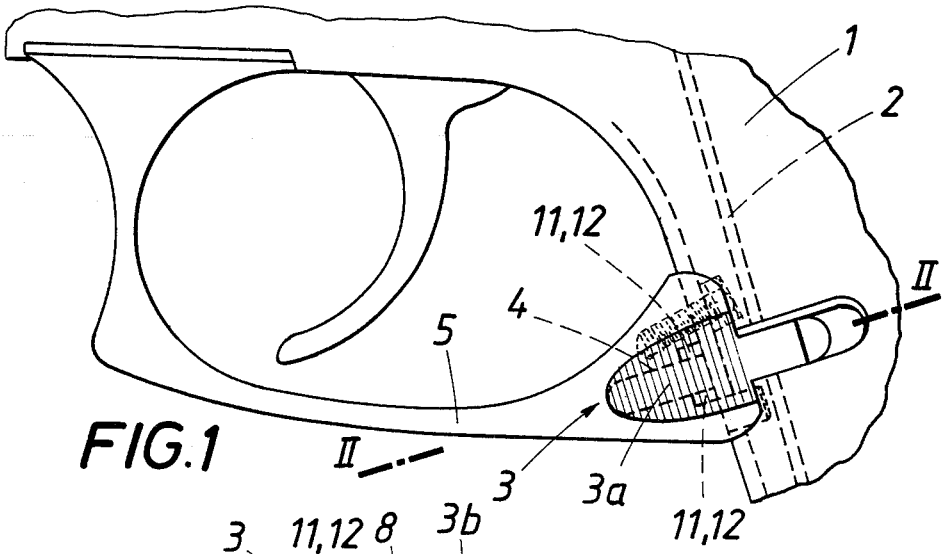
FIG.1
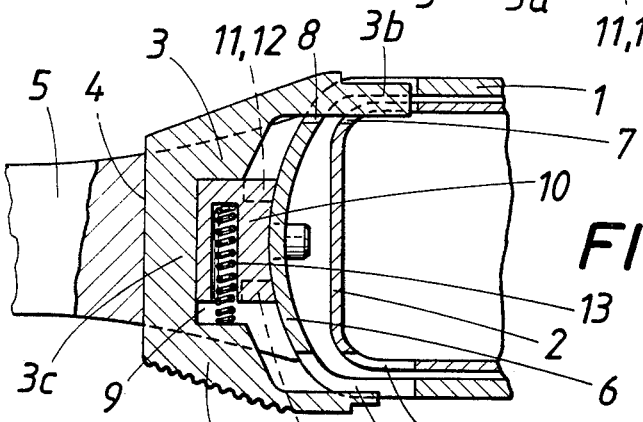
FIG.2
FIG.3
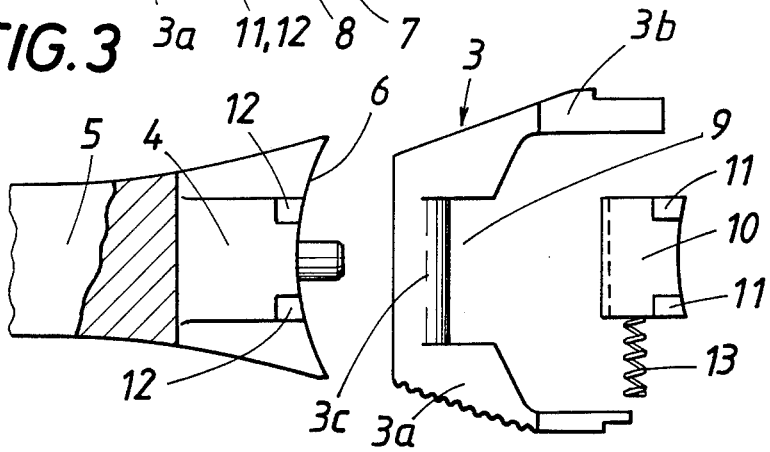

PISTOL AND GRIP-AND-TRIGGER GUARD ASSEMBLY

This invention relates to a pistol comprising a substantially U-shaped magazine catch, which is slidably mounted in a track that extends transversely to the magazine, said magazine catch comprising a first leg, which constitutes a pushpiece, and a second leg, which constitutes a locking member extending into a lateral slot of the magazine, said assembly also comprising a compression spring, which extends along the track and holds the magazine catch in locking engagement with the magazine.

Such pistol is known from Austrian Patent Specification No. 358,427 and German Patent Specification No. 28 45 121 and affords the advantage that in dependence on the position in which the magazine catch has been installed in the pistol the magazine catch can easily be operated by right-handed and left-handed persons. In the known pistol the track for the magazine catch is formed in the grip of the pistol. Two sliders, which are urged apart by a compression spring, are mounted in the crosspiece of the magazine catch between two backing surfaces, which are formed by the end faces of a recess formed in the track. In that arrangement the crosspiece of the magazine catch must be formed with an aperture, through which the sliders can extend into engagement with the backing surfaces. That design has the disadvantage that the grip must have sufficiently large dimensions to form the track for the magazine catch, that a plurality of components are required and that the alteration of the pistol from a condition for a right-handed person to a condition for a left-handed person is difficult because the removal, turning around and re-inserting of the magazine catch is a rather complicated operation.

It is an object of the invention to eliminate these disadvantages and so to improve the pistol described first hereinbefore that it is simplified in design and can more easily be altered from one condition to the other.

This object is accomplished in accordance with the invention in that the track is provided in the trigger guard, which is detachably connected to the grip in known manner, the track is open toward that surface of the trigger guard which adjoins the grip, the crosspiece of the magazine catch has a recess which accommodated an abutment member, which is held in the track by stop noses against a movement along the track, said compression spring bears at one end on said abutment member and at the other end on that leg of the magazine holder which constitues a pushpiece, said abutment member extends from said crosspiece as far as to the surface with which the trigger guard adjoins the grip, and said grip is formed with two slots for receiving the legs of the magazine holder.

Because the track is provided in the trigger guard and is open on that side which faces the grip, it is sufficient to loosen the screws connecting the trigger guard to the grip so that the entire unit consisting of the magazine catch, the abutment member and the spring can be removed, turned around and reinserted. Because the abutment member is held in the track by the stop noses, the abutment member is adapted to constitute an abutment for the spring without a need for the provision of an aperture in the crosspiece of the magazine catch so that said crosspiece will not be weakened by such aperture. The abutment member extends from the crosspiece as far as to that surface with which the trigger guard adjoins the grip so that the abutment member supplements the track for the magazine catch. The grip may have a relatively thin wall, which substantially conforms to the cross-section of the magazine so that the dimensions of the grip can be minimized. Because the legs of the magazine holder extend through two slots formed in the grip, the proper cooperation between the magazine catch and the magazine is ensured although the magazine holder is mounted in the trigger guard.

An embodiment of the invention is shown by way of example on the drawing, in which FIG. 1 is a fragmentary elevation showing a part of a pistol adjacent to the trigger guard, FIG. 2 is a transverse sectional view taken on line II—II in FIG. 1 and FIG. 3 is a view separately showing the track provided in the trigger guard, the magazine catch and the abutment member.

The pistol comprises a grip 1, which accommodates a magazine 2. The latter is held in operative position by a magazine catch 3, which is substantially U-shaped and mounted in a track 4, which extends transversely to the longitudinal direction of the grip 1 or magazine 2. The track 4 is provided in the detachable trigger guard 5 and is open toward that surface 6 of the trigger guard 5 which adjoins the grip 3. The left-hand leg of the magazine catch 3 constitutes a pushpiece 3*a*. The right-hand leg 3*b* of the magazine catch 3 constitutes a locking member, which extends into a lateral slot 7 of the magazine 2. Such lateral slot 7 is provided in the magazine 2 also on the left side thereof. To permit the leg 3*b* of the magazine catch to enter the lateral slot 7 of the magazine 2, the grip 1 is formed with two slots 8 for receiving the legs 3*a*, 3*b* of the magazine catch 3. The crosspiece 3*c* of the magazine catch 3 is formed with recess 9, which is open toward the grip and contains an abutment member 10, which is held in recesses 12 of the track by mating stop noses 11 of the abutment member 10 against a movement along the track. A compression spring 13 is mounted in the abutment member 10 and bears on that leg 3*a* of the magazine catch 3 which constitutes a pushpiece.

When the magazine catch 3 is in the position shown in FIGS. 1 and 2, the magazine catch 3 can be displaced against the force of the spring 13 by pressure applied by the thumb of the right hand to the pushpiece 3*a*. As a result, the locking member constituted by the leg 3*b* leaves the lateral slot 7 of the magazine 2 so that the latter is released for movement out of the grip 1. It is apparent from FIG. 3 that when the trigger guard 5 has been detached from the grip 1 the magazine catch together with the abutment member 10 and the spring 13 can easily be removed from the track 4 and can be turned through 180° and then be re-inserted so that the pushpiece 3*a* is then disposed on the right side of the pistol and the latter can be used by a left-handed person.

What is claimed is:

1. In a pistol comprising a grip adapted to contain a magazine that is slidable along said grip and has lateral slots on opposite sides, a trigger guard detachably secured to said grip and having a surface adjoining said grip, a track extending transversely to the longitudinal direction of said grip, a substantially U-shaped magazine catch comprising a crosspiece, which extends in said track transversely to the longitudinal direction of said grip and is slidable along said track, and first and second legs extending from said crosspiece, said first leg constituting a pushpiece, said second leg constituting a locking member adapted to extend into said grip and into one of said lateral slots of said magazine in said grip, and a compression spring, which extends along said track and biases said magazine catch to urge said second leg into said lateral slot, whereby said first leg is operable against the force of said spring to move said second leg out of said one lateral slot so as to release said magazine for movement out of said grip, the improvement residing in that said track is provided in said trigger guard and open toward said surface of said trigger guard, said crosspiece is formed with a recess, which is open toward said surface of said trigger guard, said trigger guard is formed with retaining recesses, which open into said track, an abutment member is accommodated in said recess in said crosspiece and extends from said crosspiece as far as to said surface of said trigger guard and carries locking noses received by said retaining recesses so that said abutment member is held against movement along said track, said compression spring bears at one end on said first leg and at another end on said abutment member, and said grip is formed adjacent to said trigger guard with two slots, each of which receives one of said legs of said magazine catch.

2. In a pistol grip and trigger guard assembly comprising a grip adapted to contain a magazine that is slidable along said grip and has lateral slots on opposite sides, a trigger guard detachably secured to said grip and having a surface adjoining said grip, a track extending transversely to the longitudinal direction of said grip, a substantially U-shaped magazine catch comprising a crosspiece, which extends in said track transversely to the longitudinal direction of said grip and is slidable along said track, and first and second legs extending from said crosspiece, said first leg constituting a pushpiece, said second leg constituting a locking member adapted to extend into said grip and into one of said lateral slots of said magazine in said grip and a compression spring, which extends along said track and biases said magazine catch to urge said second leg into said lateral slot, whereby said first leg is operable against the force of said spring to move said second leg out of said one lateral slot so as to release said magazine for movement out of said grip, the improvement residing in that said track is provided in said trigger guard and open toward said surface of said trigger guard, said crosspiece is formed with a recess, which is open toward said surface of said trigger guard, said trigger guard is formed with retaining recesses, which open into said track, an abutment member is accommodated in said recess in said crosspiece and extends from said crosspiece as far as to said surface of said trigger guard and carries locking noses received by said retaining recesses so that said abutment member is held against movement along said track, said compression spring bears at one end on said first leg and at another end on said abutment member, and said grip is formed adjacent to said trigger guard with two slots, each of which receives one of said legs of said magazine catch.

3. A trigger guard and magazine catch assembly for a pistol comprising a grip adapted to contain a magazine that is slidable along said grip and has lateral slots on opposite sides, said assembly comprising a trigger guard having a surface and adapted to be detachably secured to said grip so that said surface adjoins said grip, a track provided in aid trigger guard and extending transversely to the longitudinal direction of said trigger guard and open toward said surface of said trigger guard and formed with retaining recesses, a substantially U-shaped magazine catch comprising a crosspiece which extends in and along said track and is slidable along said track, and first and second legs extending from said crosspiece, said first leg constituting a pushpiece, said second leg constituting a locking member, said crosspiece being formed with a recess, which is open toward said surface of said trigger guard, an abutment member accommodated in said recess in said crosspiece and extending from said crosspiece as far as to said surface of said trigger guard and carrying locking noses received by said retaining recesses so that said abutment member is held against movement along said track, and a compression spring, which extends along said track and bears at one end on said first leg and at another end on said abutment member and biases said magazine catch in one direction along said track, whereby said first leg is operable to move said magazine catch along said track against the force of said spring.

* * * * *